US006235085B1

(12) United States Patent
Masso et al.

(10) Patent No.: US 6,235,085 B1
(45) Date of Patent: May 22, 2001

(54) HIGH CARBON CONTENT BRIQUETTES

(75) Inventors: Emilio Quero Masso; David Carrasquero, both of Bolívar (VE)

(73) Assignee: Orinoco Iron, C.A., Caracas (VE)

( * ) Notice: Subject to any disclaimer, the term of this patent is extended or adjusted under 35 U.S.C. 154(b) by 0 days.

(21) Appl. No.: 09/563,605

(22) Filed: May 2, 2000

Related U.S. Application Data

(62) Division of application No. 09/003,030, filed on Jan. 5, 1998, now Pat. No. 6,096,112.

(51) Int. Cl.[7] ..... C22B 1/24
(52) U.S. Cl. ..... 75/770; 75/71; 75/61
(58) Field of Search ..... 75/770, 951, 771

(56) References Cited

U.S. PATENT DOCUMENTS 4,731,112 * 3/1988 Hoffman ..... 75/10.22

* cited by examiner

*Primary Examiner*—Roy King
*Assistant Examiner*—Tima McGuthny-Banks
(74) *Attorney, Agent, or Firm*—Bachman & LaPointe, P.C.

(57) ABSTRACT

A process for preparing high carbon content briquettes includes providing a particulate material which includes iron particles including iron oxide in an amount of at least about 4% based on weight of the material, and carbon particles in an amount greater than about 2% based on weight of the material; and subjecting the material to briquetting temperature and pressure so as to provide stable agglomerate briquettes of the material.

10 Claims, No Drawings

HIGH CARBON CONTENT BRIQUETTES

This is a Division of application Ser. No. 09/003,030 filed Jan. 5, 1998 now U.S. Pat. No. 6,096,112.

BACKGROUND OF THE INVENTION

The invention relates to briquettes which are useful as feed material, particularly in iron and steel making processes and, more particularly to a high carbon content briquette and process for preparing same.

The production of suitably stable agglomerates from fine or coarse particles of iron oxide for use as feed material in iron and steel making furnaces is a well-established and rapidly expanding field. Production of such agglomerates are accomplished by means of bonding particles using suitable cementing particles or binders, followed by sintering, firing and cementing procedures. Hot briquetting is a process whereby iron ore particles are agglomerated using compacting techniques and the proper combination of chemical reduction, heat and pressure. Briquettes produced using such techniques are commercially known as hot briquetted iron (HBI). The hot briquetting technique, without binders, has been successfully completed using highly metallized materials which contain from about 0.01% up to a maximum of 2% carbon. When the carbon content exceeds 2%, known compacting techniques do not provide a sufficiently stable agglomerate material.

Thus, the need exists for a process for preparing briquettes from starting material having a higher carbon content.

It is therefore the primary object of the present invention to provide a process whereby high-carbon content iron particles can be agglomerated so as to provide a suitable stable briquette.

It is a further object of the present invention to provide a process for preparing high carbon content briquettes with no additional binders, and containing no fused slag or vitreous phases.

It is a further object of the present invention to provide a high carbon content briquette which is useful as a feed material in iron and steel making furnaces, and which has excellent physical properties.

Other objects and advantages of the present invention will appear hereinbelow.

SUMMARY OF THE INVENTION

In accordance with the present invention, the foregoing objects and advantages have been readily attained.

According to the invention, a process is provided for preparing high carbon content briquettes, which process comprises the steps of providing a particulate material comprising iron particles including iron oxide in an amount of at least about 4% based on weight of said material, and carbon particles in an amount greater than about 2% based on weight of said material; and subjecting said material to briquetting temperature and pressure so as to provide stable agglomerate briquettes of said material.

In further accordance with the present invention, a high carbon content briquette is provided, which briquette comprises a stable agglomerate of iron particles and carbon particles, said iron particles including metallized iron and iron oxide, said iron oxide being present in an amount of at least about 4% based on weight of said briquette, and said carbon particles being present in an amount greater than about 2.0% based on weight of said briquette.

DETAILED DESCRIPTION

The invention relates to a high carbon content briquette which is useful as feed material for iron and steel making processes, and to a process for preparing high carbon content briquettes.

In accordance with the invention, and advantageously, a process is provided whereby iron particles containing a substantial amount of carbon can be agglomerated into useful feed material briquettes without the need for additional binders and the like.

In accordance with the invention, high carbon content briquettes, or high carbon briquettes (HCB), are produced starting with a particulate material containing iron particles and carbon particles, wherein the iron contains metallized or reduced iron as well as iron oxide, and wherein carbon is present in an amount greater than about 2.0%, preferably between about 2.1% and about 6.5%, based upon weight of the starting particulate material. This is an advantage over known processes which require that the material include carbon in far smaller amounts, typically between about 0.01% up to a maximum of 2.0%.

It has been found in accordance with the present invention that stable agglomerates or briquettes can be prepared even with the increased amount of carbon when the iron particles include specific amounts of metallized iron and iron oxide.

According to the invention, the starting particulate material preferably includes at least about 80% total iron, more preferably between about 88% and about 93% total iron with respect to weight of the starting particulate material, and it is preferred that the material include metallized or reduced iron in an amount between about 85% and about 89% with respect to weight of the starting material, and iron oxide in an amount between about 4% and about 6% with respect to weight of the starting material. The starting particulate material may suitably be fine or coarse particles. It is particularly preferred that the starting particulate material have a particle size in the range of from about 0.1 mm to about 10 mm. Suitable starting particulate matter may be characterized by granulometric analysis showing about 11.5% to about 18.62%+16 mesh, from about 32.7% to about 36.83%+100 mesh, and from about 40% to about 57.22%−100 mesh.

Still further in accordance with the present invention, the starting particulate material is preferably provided having a binding index, or ratio of iron oxide (Fe+2) to metallized iron of between about 0.03 and about 0.05.

The carbon particle portion of the starting particulate material is preferably present in the form of cementite ($Fe_3C$) and graphite, and preferably includes between about 85% and about 95% cementite and between about 5% and about 15% graphite with respect to weight of the carbon particles.

Such carbon particles, particularly cementite, are known to be sufficiently hard that briguetting through the application of temperature and pressure is difficult. In accordance with the present invention, however, the starting particulate material characterized as set forth above can be subjected to briquetting temperature and pressure, preferably a temperature of between about 650° C. and about 750°C. and a pressure of between about 250 kg/cm$^2$ and about 350 kg/cm$^2$, such that the metallized iron and iron oxide, or wustite, flow into voids and spaces between the high carbon content particles, especially the cementite particles, so as to directly bond the iron particles to the carbon particles so as to form a stable agglomerate briquette as desired.

The process as set forth above in accordance with the present invention can readily be used to provide briquettes of agglomerated particulate material, which are particularly useful as feed materials for iron and steel making processes, and which briquettes comprise stable agglomerate of iron particles and carbon particles wherein total iron is present in an amount of at least about 80% weight, and carbon is present in an amount of greater than about 2.0% weight, preferably between about 2.1% and about 6.5% weight with respect to the briquettes. The total iron content of the briquettes is preferably between about 88% and about 93%, and the metallized iron portion of this iron is preferably present in an amount between about 85% and about 89% based on weight of the briquettes.

Briquettes prepared in accordance with the present invention are characterized by a density of between about 4.4 $g/cm^3$ and about 5.6 $g/cm^3$, and a breakdown index of between about 1.4% (wt.) and about 1.6% (wt.)–6 mm. As used herein, the breakdown index is the percent of ore fines from briquettes having a size less than a given size here 6 mm, after the briquettes have been subjected to a standard breakdown test. This breakdown index exhibited by briquettes according to the present invention is advantageous in that the briquettes, although made using high carbon content materials, exhibit density and breakdown indexes which are as good as values found in connection with conventional hot briquetted iron using starting materials having a maximum carbon content of 2%. Thus, in accordance with the present invention, a briquette and process for preparing same are provided wherein the starting materials can acceptably have a far greater carbon content, and the finishing briquette is nevertheless an extremely suitable feed material for the desired processes. Furthermore, the high carbon content material used in accordance with the present invention is advantageous due to the high energy content and the energy and associated cost savings provided by use of same. Briquettes in accordance with the present invention are also characterized by enhanced weather resistance due to the reduced tendency to react with moisture, and the lower tendency of the carbides to react with water.

As set forth above, the starting particulate material for use in accordance with the present invention is not restricted to the use of fines, but could also include coarse or lumpy material due to the fact that the briquette forming process of the present invention effectively welds the particles together, and the strength of the resulting briquettes depends primarily on the strength of the bonds between the particles.

The high carbon content briquettes of the present invention have excellent physical strength for withstanding transport and handling in steel and iron shops, and further exhibits a lower level of fines and dust which contain free carbon, thereby reducing environmental pollution associated with the handling of same.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for preparing high carbon content briquettes, comprising the steps of:

providing a particulate material comprising iron particles including iron oxide in an amount of at least about 4% based on weight of said material, and carbon particles in an amount greater than about 2% based on weight of said material wherein said carbon particles comprise cementite in an amount between about 85% and about 95% based on weight of said carbon particles, and graphite in an amount between about 5% and about 15% based on weight of said carbon particles; and subjecting said material to briquetting temperature and pressure so as to provide stable agglomerate briquettes of said material.

2. A process according to claim 1, wherein said subjecting step causes said iron and said iron oxide to flow between said carbon particles so as to directly bond said iron particles and said carbon particles.

3. A process according to claim 1, wherein said providing step comprises providing said particulate material comprising at least about 80% total iron including said iron oxide in an amount between about 4% and about 6%, and comprising said carbon particles in an amount between about 2.1% and about 6.5% based on weight of said particulate material.

4. A process according to claim 1, wherein said providing step comprises providing said material consisting essentially of said iron particles and said carbon particles, whereby said briquettes are substantially free of binders.

5. A process according to claim 1, wherein said providing step comprises providing said material including total iron in an amount between about 88% and about 93% based on weight of said material.

6. A process according to claim 1, wherein said providing step comprises providing said material including metallized iron and said iron oxide at a ratio by weight of said iron oxide to said metallized iron of between about 0.03 and about 0.05.

7. A process according to claim 1, wherein said briquetting temperature and pressure comprise a temperature of between about 650° C. and about 750° C. and a pressure of between about 250 $kg/cm^2$ and about 350 $kg/cm^2$.

8. A process according to claim 1, wherein said subjecting step provides briquettes containing iron and carbon wherein said carbon is present in an amount greater than about 2% based on total weight of said briquettes.

9. A process according to claim 1, wherein said subjecting step provides said briquettes having a density of between about 4.4 $g/cm^3$ and about 5.6 $g/cm^3$, and a breakdown index of between about 1.4% (wt.) and about 1.6% (wt.)–6 mm.

10. A process according to claim 1, wherein said particulate material has a particle size in a range of from about 0.1 mm to about 10 mm.

* * * * *